US006243958B1

(12) United States Patent
Ringley, Jr.

(10) Patent No.: US 6,243,958 B1
(45) Date of Patent: Jun. 12, 2001

(54) ILLUMINATED EVIDENCE MARKER

(76) Inventor: Michael B. Ringley, Jr., 1301 Apache Pine Dr., Ladson, SC (US) 29456

( * ) Notice: Subject to any disclaimer, the term of this patent is extended or adjusted under 35 U.S.C. 154(b) by 0 days.

(21) Appl. No.: 09/320,773

(22) Filed: May 27, 1999

(51) Int. Cl.[7] ..... B43L 7/027
(52) U.S. Cl. ..... 33/474; 116/209
(58) Field of Search ..... 116/63 C, 209; 33/474, 476, 481

(56) References Cited

U.S. PATENT DOCUMENTS

| | | | | |
|---|---|---|---|---|
| 1,097,393 | * | 5/1914 | Criswell | 33/481 |
| 2,483,734 | * | 10/1949 | Neal | 116/209 |
| 4,466,376 | * | 8/1984 | Wells | 116/63 C |
| 4,772,869 | | 9/1988 | Grammas et al. . | |
| 5,036,791 | | 8/1991 | Thurston . | |
| 5,115,343 | * | 5/1992 | Bennett | 116/63 C |
| 5,199,375 | | 4/1993 | Johson . | |
| 5,294,924 | | 3/1994 | Dydzyk . | |
| 5,343,825 | * | 9/1994 | Gazecimeon et al. | 116/209 |
| 5,577,824 | * | 11/1996 | Wright | 116/63 C |
| 5,786,758 | * | 7/1998 | Bullock | 116/209 |
| 5,787,616 | * | 8/1998 | Rogers | 116/209 |
| 5,915,852 | * | 6/1999 | Rogers | 116/209 |

* cited by examiner

*Primary Examiner*—G. Bradley Bennett
(74) *Attorney, Agent, or Firm*—B. Craig Killough

(57) ABSTRACT

An illuminated evidence marker has a translucent pylon. A battery powered light is present in the interior of the pylon, and illuminates the pylon. The pylon has indicia, such as numbers or letters, on each side thereof, which may be in sequence when combined with other markers. The pylon sits on a base, which may have a scale formed or printed thereon.

11 Claims, 3 Drawing Sheets

ILLUMINATED EVIDENCE MARKER

FIELD OF INVENTION

This invention relates to crime scene evidence markers.

BACKGROUND OF THE INVENTION

Evidence which is identified and collected at crime scenes must be painstakingly preserved and accounted for. It is necessary to photograph each item of evidence as it appears at the crime scene, without moving or damaging the evidence, so that the evidence and crime scene are preserved.

It is common to place numbers, letters, or other indicia beside articles of evidence, so that each article of evidence can be identified by sequential systems, such as numbers or letters. However, the size of the object is not apparent without more. It is also common to place an object of known size, such as a coin, adjacent to the object, or to place a ruler next to the object, so that a sense of scale is observed from viewing the photograph.

It is important that the evidence is not inadvertently moved or trampled under foot. Improperly handling of evidence may render critical evidence inadmissible in court.

It is desirable to have evidence markers which are lighted so that they can be seen easily at night. It is also desirable to have evidence markers with sequential indicia on all sides thereof for easy viewing. It is further desirable to have evidence markers having a scale thereon, which will appear in pictures of the evidence.

SUMMARY OF THE INVENTION

The present invention is an illuminated evidence marker. The evidence marker has a translucent pylon. A battery powered light is present in the interior of the pylon, and illuminates the pylon. The pylon has indicia, such as sequential numbers or letters, thereon. The pylon sits on a base, which may have a scale formed or printed thereon.

DESCRIPTION OF THE PREFERRED EMBODIMENT

Figure 1:
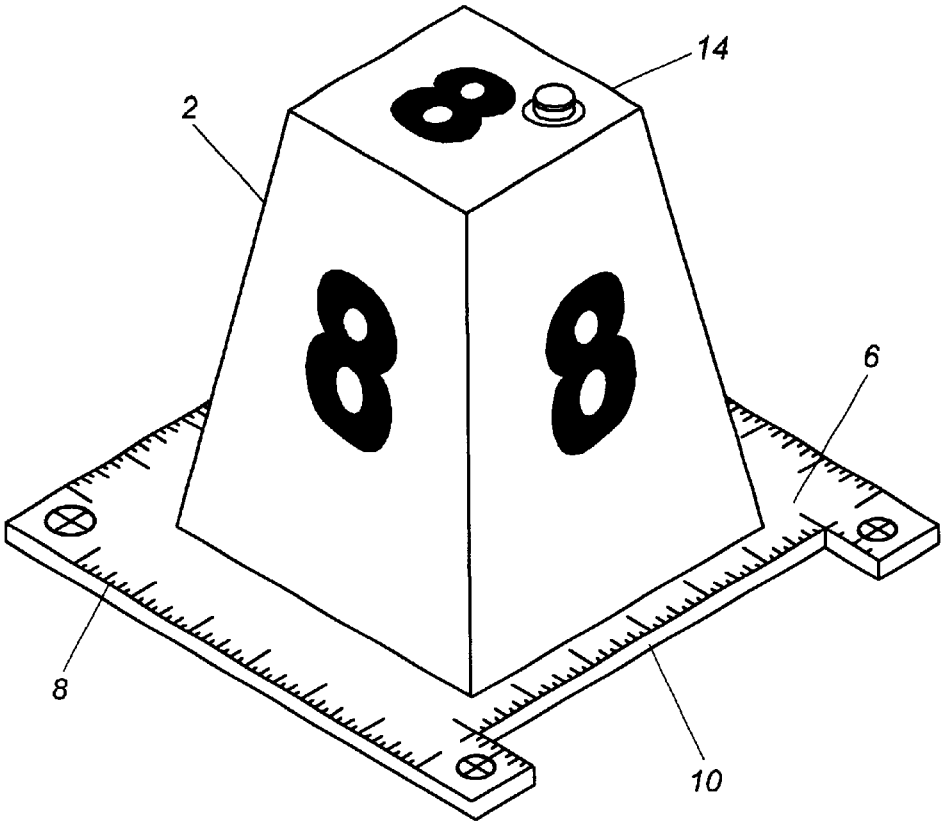
FIG. 1 is a perspective view of the illuminated evidence marker.

Referring now to the drawing figures, FIG. 1 shows the illuminated evidence marker as a truncated pyramidal pylon 2. The pylon has indicia on each side thereof, and on the top thereof. The indicia 4 as shown is a number 8. The number 8 is shown on each side, and on the top. The evidence marker may be numbered sequentially beginning with "1", or alphabetically beginning with "A", so that evidence is marked and processed in an orderly manner which allows later identification of the evidence in a photograph.

The pylon as shown has four sides. The pylon could have three sides, or more than four sides. However, a pylon with four sides provides a device which allows the number or other indicia to be visible from virtually any angle when photographed, without the necessity of moving the evidence markers. Movement of the evidence or the marker could lead to inadvertent contact of the evidence marker with the evidence, and destruction of the evidentiary value of the article. The sloped sides of the pylon, with the pylon having four sides and a top, each marked with a number or other indicia, provides an evidence marker which most satisfactorily reveals the indicia during photographing.

The pylon is preferred to be mounted on a base 6. The base is preferred to have the same number of sides as the pylon. The base as shown has four sides.

The base is preferred to have a scale 8 along at least a portion thereof. It is preferred to have a scale along each side, so that the scale is present next to the evidence, no matter how the marker is positioned relative to the evidence. It is preferred that two of the sides are scaled in inches, with one side in centimeters. The notched area is preferred to have a scale in both inches and centimeters.

Figure 2:
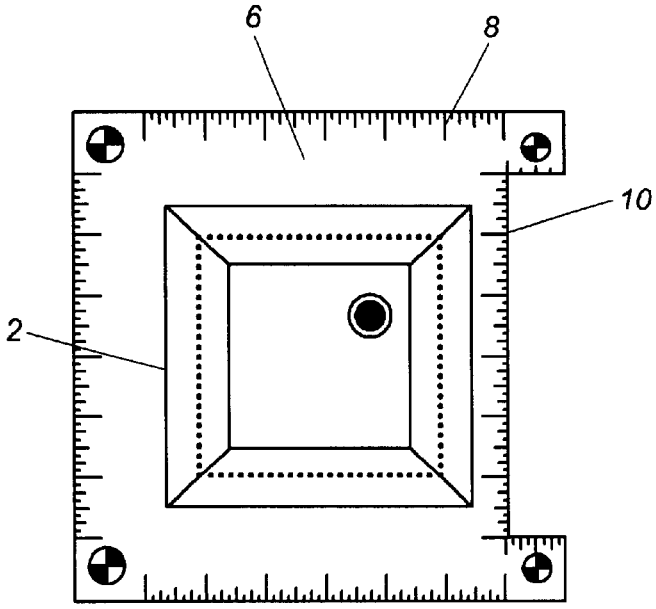
FIG. 2 is a top plan view of the illuminated evidence marker.

As shown in FIGS. 1 and 2, one side of the base has a notched area 10 or side. The evidence may be located within the notched area, and immediately adjacent to the notched area, so that the photograph will clearly indicate the size of the evidence by means of the scale. Since the scale, as shown, is also present on the sides of the notch, a small item located within the notch can be scaled according to length and width. When a photograph is taken from above, with evidence located within a notch, the indicia clearly shows the sequential designation of the evidence, as well as the size of the evidence.

Figure 3:
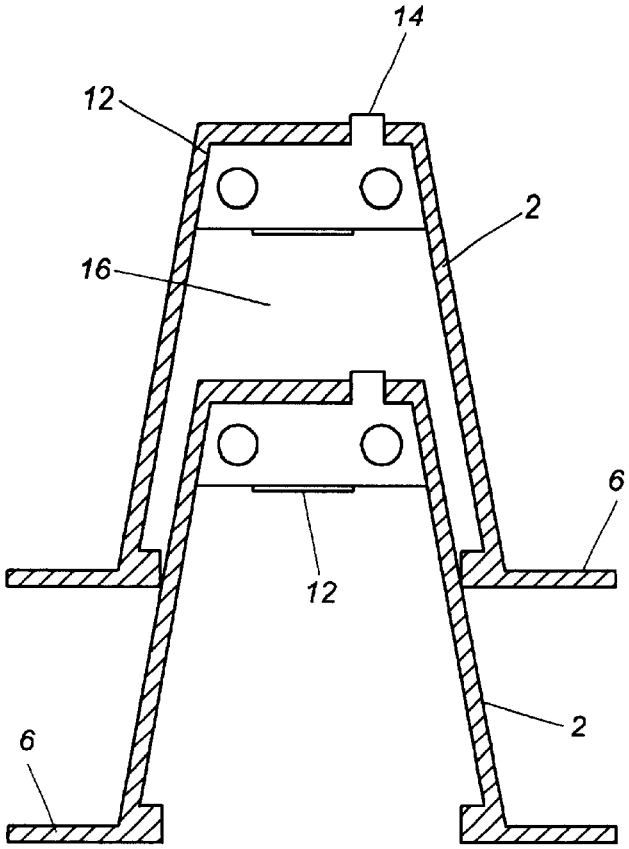
FIG. 3 is a side, sectioned view of two of the illuminated evidence markers.
Figure 4:
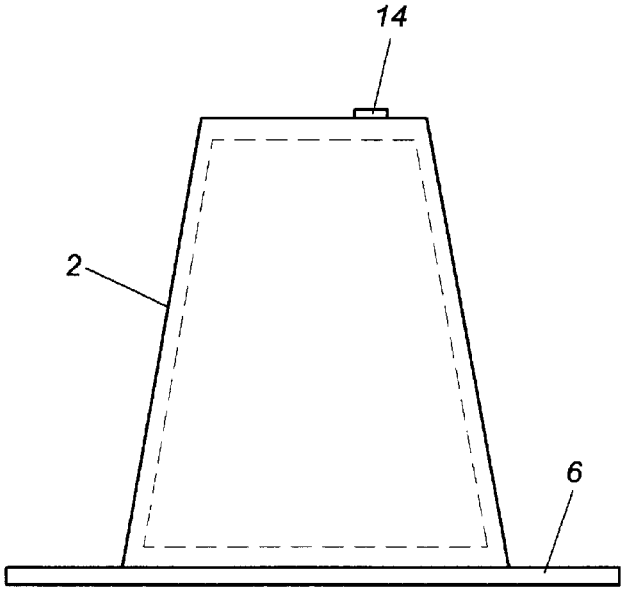
FIG. 4 is a side elevation of the illuminated evidence marker.
Figure 5:
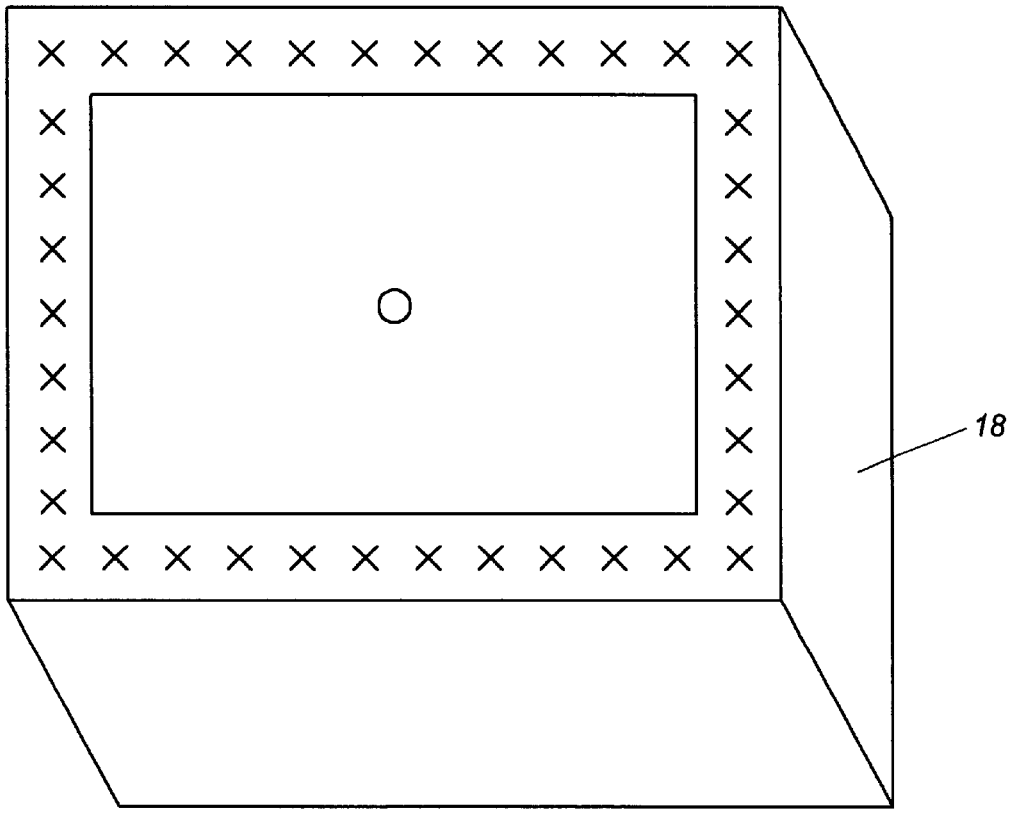
FIG. 5 is a perspective view of a flotation member which may be inserted into the device.
Figure 6:
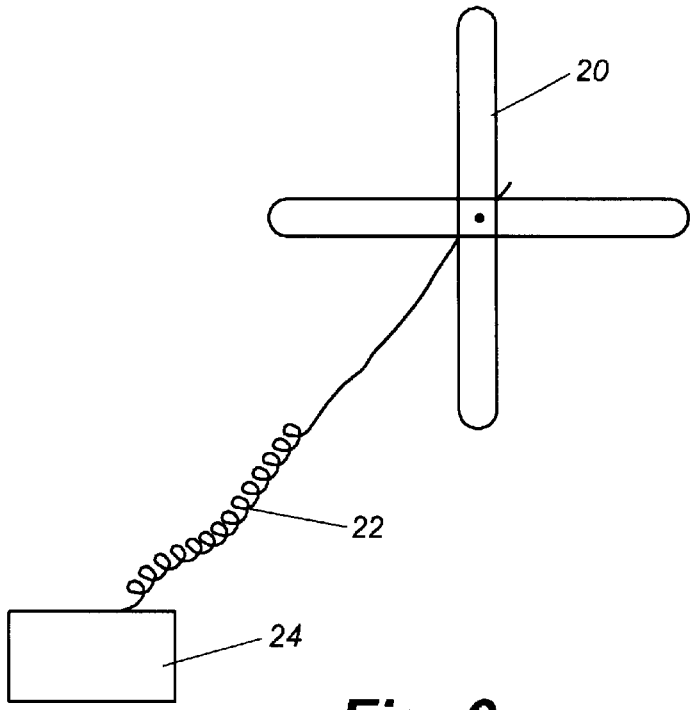
FIG. 6 demonstrates a stay which is snapped into the device to retain the flotational member, and which is tethered to a weighting device.

A light is provided for illuminating the marker. The marker is formed of a translucent material which allows light to be emitted through the sides of the pylon. As shown in FIG. 3, a battery powered light unit 12 is positioned in an interior of the pylon. The light is formed as a modular unit, having one or more light bulbs which are powered by batteries. The modular light kit snaps into the upper portion of the pylon as shown as FIG. 3. The decreasing cross-sectional sides of the pylon afforded by the truncated pyramidal shape of the pylon holds the modular light unit in the upper portion of the pylon. A void is formed in the top surface of the pylon so that an on/off switch 14, which is formed as part of the modular light unit is accessible from the top of the pylon. This position allows easy access to the on/off switch of the pylon, while allowing the on/off switch to be part of the modular light unit.

The pylon is generally hollow, forming an opening 16 in the pylon. The base, shown in FIG. 3, does not extend materially into or under the interior of the pylon, so that an opening in the base is formed. The opening in the base, and the hollow structure of the evidence marker allows the markers to be nested as shown in FIG. 3, with multiple markers stacked for easy transportation and storage of the markers.

In use, the markers are sequentially placed next to evidence at a crime scene to be photographed. At night or in other low light situations, the light is actuated to illuminate the marker. The translucent structure of the pylon, which is preferred to be formed of plastic in a bright color, such as yellow, allows light to exit the interior of the pylon through the translucent sides. The number or other indicia is not translucent, so that the marker and its indicia are clearly visible from a substantial distance.

The bright color of the marker, and the illumination of the marker in appropriate situations, prevent evidence from being accidentally moved, kicked or walked on. The illumination allows the marker to be photographed from beyond a normal camera flash range. Typically, enough light is emitted from the device to allow auto focusing while photographing the evidence with an appropriate camera.

In appropriate bad weather situations, the hollow design of the device allows it to be used to shield evidence. Evidence that is adversely affected by rain, or other precipitation, or wind may be protected by placing the evidence marker on top of the evidence. A flotation device 18 may be inserted into the inner cavity of the evidence marker, to facilitate flotation of the device in water. The flotation device may be formed of low density material, or it may be an inflated bladder. A stay 20 may be used to retain the flotation device within the pylon. The stay may be snapped into the base or pylon by means of a ridge formed on the base or pylon. The device may be anchored by a tether 22 attached to the stay and to a weight 24.

The device may be affixed to various materials by the application of rubberized magnets. Velcro may be applied to the base for adhesion to other objects.

An optional light kit may perform as a strobe or as a flashing unit.

What is claimed is:

1. An illuminated evidence marker, comprising:

a. a translucent pylon having indicia thereon; and b. a battery powered light which is positioned in an interior of said pylon;

c. a base which joins said pylon at a bottom perimeter of said pylon and extends beyond said pylon along an entire length of said bottom perimeter of said pylon, said base having a measuring scale along a length thereof.

2. An illuminated evidence marker as described in claim 1, wherein said base has measuring scales on at least two sides thereof, and wherein a first side and an opposite side of said base extend beyond a side which is between said first side and said opposite side to form a notch in said base, and wherein a scale is present within said notch.

3. An illuminated evidence marker as described in claim 1, wherein said pylon has at least three sides, and said pylon has the same indicia present on each of said at least three sides.

4. An illuminated evidence marker as described in claim 3, wherein said evidence marker has the same indicia present on a top surface of said pylon.

5. An illuminated evidence marker as described in claim 1, wherein said evidence marker has flotational material present in an interior thereof.

6. An illuminated evidence marker, comprising a. a truncated pyramidal shaped pylon having at least four sides, said pylon having indicia on each side thereof, wherein said pylon is formed of a translucent material on each side thereof;

b. a battery powered light which is positioned in an interior of said pylon; and c. a base which joins said pylon and extends beyond said pylon along an entire bottom perimeter of said pylon, said base having an number of sides equal to said pylon, wherein each of said sides of said base correspond to one of said sides of said pylon.

7. An illuminated evidence marker as described in claim 6, wherein said base has a measuring scale along a length thereof.

8. An illuminated evidence marker as described in claim 6, wherein said base has measuring scales on at least two sides thereof, and wherein a first side and an opposite side of said base extend beyond a side which is between said first side and said opposite side to form a notch in said base, and wherein a scale is present within said notch.

9. An illuminated evidence marker as described in claim 6, wherein said evidence marker has the same indicia present on each side of said truncated pyramidal pylon and said evidence marker has the same indicia present on a top surface of said truncated pyramidal pylon.

10. An illuminated evidence marker as described in claim 8, wherein said evidence marker has the same indicia present on each side of said truncated pyramidal pylon and said evidence marker has the same indicia present on a top surface of said truncated pyramidal pylon.

11. An illuminated evidence marker as described in claim 6, wherein said evidence marker has flotational material present in an interior thereof.

* * * * *